US011274618B2

(12) United States Patent
Andersson et al.

(10) Patent No.: US 11,274,618 B2
(45) Date of Patent: Mar. 15, 2022

(54) ENGINE FUEL SUPPLY CONTROL STRATEGY

(71) Applicant: Walbro LLC, Tucson, AZ (US)

(72) Inventors: Martin N. Andersson, Caro, MI (US); Cyrus M. Healy, Ubly, MI (US); Dale P. Kus, Cass City, MI (US)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 16/763,092

(22) PCT Filed: Nov. 27, 2018

(86) PCT No.: PCT/US2018/062538

§ 371 (c)(1),
(2) Date: May 11, 2020

(87) PCT Pub. No.: WO2019/104298

PCT Pub. Date: May 31, 2019

(65) Prior Publication Data

US 2020/0291881 A1 Sep. 17, 2020

Related U.S. Application Data

(60) Provisional application No. 62/590,867, filed on Nov. 27, 2017.

(51) Int. Cl.
*F02D 31/00* (2006.01)
*F02D 37/02* (2006.01)
(Continued)

(52) U.S. Cl.
CPC ..... *F02D 41/123* (2013.01); *F02D 31/003* (2013.01); *F02D 41/12* (2013.01);
(Continued)

(58) Field of Classification Search
CPC ..... F02D 31/003; F02D 31/37; F02D 31/02; F02D 41/08; F02D 41/12; F02D 41/123;
(Continued)

(56) References Cited

U.S. PATENT DOCUMENTS 5,709,193 A 1/1998 Svensson et al.
7,000,595 B2 * 2/2006 Andersson ..... F02P 5/045 123/406.47

(Continued)

OTHER PUBLICATIONS

Written Opinion & International Search Report for PCT/US2018/062538 dated Apr. 4, 2019, 11 pages.

*Primary Examiner* — Audrey B. Walter
(74) *Attorney, Agent, or Firm* — Reising Ethington P.C.; Matthew J. Schmidt

(57) ABSTRACT

In at least some implementations, a method of controlling a fuel-to-air ratio of a fuel and air mixture supplied to an engine, includes the steps of determining an engine deceleration event, determining the number of engine revolutions required for the engine speed to decrease from one speed threshold to another speed threshold, comparing the number of engine revolutions determined above against a revolution threshold, and making the fuel and air mixture richer if the number of engine revolutions determined above is greater than the revolution threshold. The method may also include determining if, before the engine stabilized at a stable engine speed (which may be an engine idle speed), the engine speed decreased below the stable engine speed as the engine decelerated to the stable engine speed from a speed above the stable engine speed, and making the fuel and air mixture leaner if the determination is affirmative.

19 Claims, 6 Drawing Sheets

(51) Int. Cl.

| | |
|---|---|
| ***F02D 41/08*** | (2006.01) |
| ***F02D 41/12*** | (2006.01) |
| ***F02D 41/14*** | (2006.01) |
| *F02D 41/00* | (2006.01) |

(52) U.S. Cl.
CPC ..... *F02D 41/1475* (2013.01); *F02D 37/02* (2013.01); *F02D 41/08* (2013.01); *F02D 2041/001* (2013.01); *F02D 2200/101* (2013.01); *F02D 2700/02* (2013.01)

(58) Field of Classification Search
CPC ..... F02D 41/1475; F02D 2041/001; F02D 2200/101; F02D 2700/02
See application file for complete search history.

(56) References Cited

U.S. PATENT DOCUMENTS

| | | | | |
|---|---|---|---|---|
| 9,188,066 | B2 * | 11/2015 | Yamashita | F02P 5/1504 |
| 9,255,535 | B2 | 2/2016 | Larsson | |
| 2007/0149352 | A1 | 6/2007 | Bidner et al. | |
| 2016/0032855 | A1 * | 2/2016 | Andersson | F02D 35/0007 701/103 |
| 2017/0314490 | A1 | 11/2017 | Andersson et al. | |
| 2018/0171929 | A1 * | 6/2018 | Kim | F02D 41/402 |

* cited by examiner

ENGINE FUEL SUPPLY CONTROL STRATEGY

REFERENCE TO RELATED APPLICATIONS

This application claims the benefit of U.S. Provisional Application Ser. No. 62/590,867 filed on Nov. 27, 2017 the entire contents of which are incorporated herein by reference in its entirety.

TECHNICAL FIELD

The present disclosure relates generally to strategy for supplying fuel to a combustion engine.

BACKGROUND

Combustion engines are provided with a fuel mixture that typically includes liquid fuel and air. The air/fuel ratio of the fuel mixture may be calibrated for a particular engine, but different operating characteristics such as loads, acceleration, deceleration, type of fuel, altitude, condition of filters or other engine components, and differences among engines and other components in a production run may affect engine operation.

SUMMARY

In at least some implementations, a method of controlling a fuel-to-air ratio of a fuel and air mixture supplied to an operating engine, includes the steps of determining an engine deceleration event, determining the number of engine revolutions required for the engine speed to decrease from one speed threshold to another speed threshold, comparing the number of engine revolutions determined above against a revolution threshold, and making the fuel and air mixture richer if the number of engine revolutions determined above is greater than the revolution threshold. In at least some implementations, the method also includes determining if, before the engine stabilized at a stable engine speed (which may be an engine idle speed), the engine speed decreased below the stable engine speed as the engine decelerated to the stable engine speed from a speed above the stable engine speed, and making the fuel and air mixture leaner if the determination is affirmative.

In at least some implementations, a deceleration event is determined if the engine speed is above a first speed threshold for a first threshold number of engine revolutions and when the engine speed decreases below the first speed threshold. Determining a deceleration event may include comparing a rate of deceleration against a deceleration rate threshold. An engine deceleration event may be determined by a decrease in engine speed of between 10 rpm and 4,000 rpm from a first speed threshold, in at least some implementations.

In at least some implementations, the two speed thresholds are lower speeds than said first speed threshold. The another speed threshold may be greater than or equal to a nominal idle speed of the engine, and may be between 2,000 rpm and 5,000 rpm. The fuel and air mixture may be made richer if the number of engine revolutions determined above is greater than the revolution threshold. The revolution threshold may, in at least some implementations, be between 10 revolutions and 300 revolutions.

In at least some implementations, the richness of the fuel and air mixture is controlled at least in part by an electrically actuated valve and the richness of the fuel and air mixture is changed by changing the operation of the valve. The valve may control a flow of fuel and closing the valve for a longer duration of time over a given time period may result in a leaner fuel and air mixture and closing the valve for a shorter duration of time for said given time period results in a richer fuel and air mixture. The valve may control a flow of air and closing the valve for a longer duration of time over a given time period may result in a richer fuel and air mixture and closing the valve for a shorter duration of time for said given time period results in a leaner fuel and air mixture.

In at least some implementations, a method of controlling a fuel-to-air ratio of a fuel and air mixture supplied to an operating engine, comprises the steps of:

(a) determining an engine deceleration event;
(b) detecting one or more deceleration characteristics;
(c) comparing the one or more deceleration characteristics to one or more thresholds associated with the one or more deceleration characteristics; and
(d) determining if the fuel and air mixture should be made richer or leaner based on the comparison in step (c).

The one or more deceleration characteristics may include the number of engine revolutions required for the engine speed to decrease from one speed threshold to another speed threshold. Step (c) may include comparing the number of engine revolutions required for the engine speed to decrease from said one speed threshold to said another speed threshold against a revolution threshold. In step (d), the fuel and air mixture may be made richer if the number of engine revolutions required for the engine speed to decrease from said one speed threshold to said another speed threshold is greater than the revolution threshold. The revolution threshold may, in at least some implementations, be between 10 revolutions and 300 revolutions.

BRIEF DESCRIPTION OF THE DRAWINGS

The following detailed description of certain embodiments and best mode will be set forth with reference to the accompanying drawings, in which.

DETAILED DESCRIPTION

Figure 1:
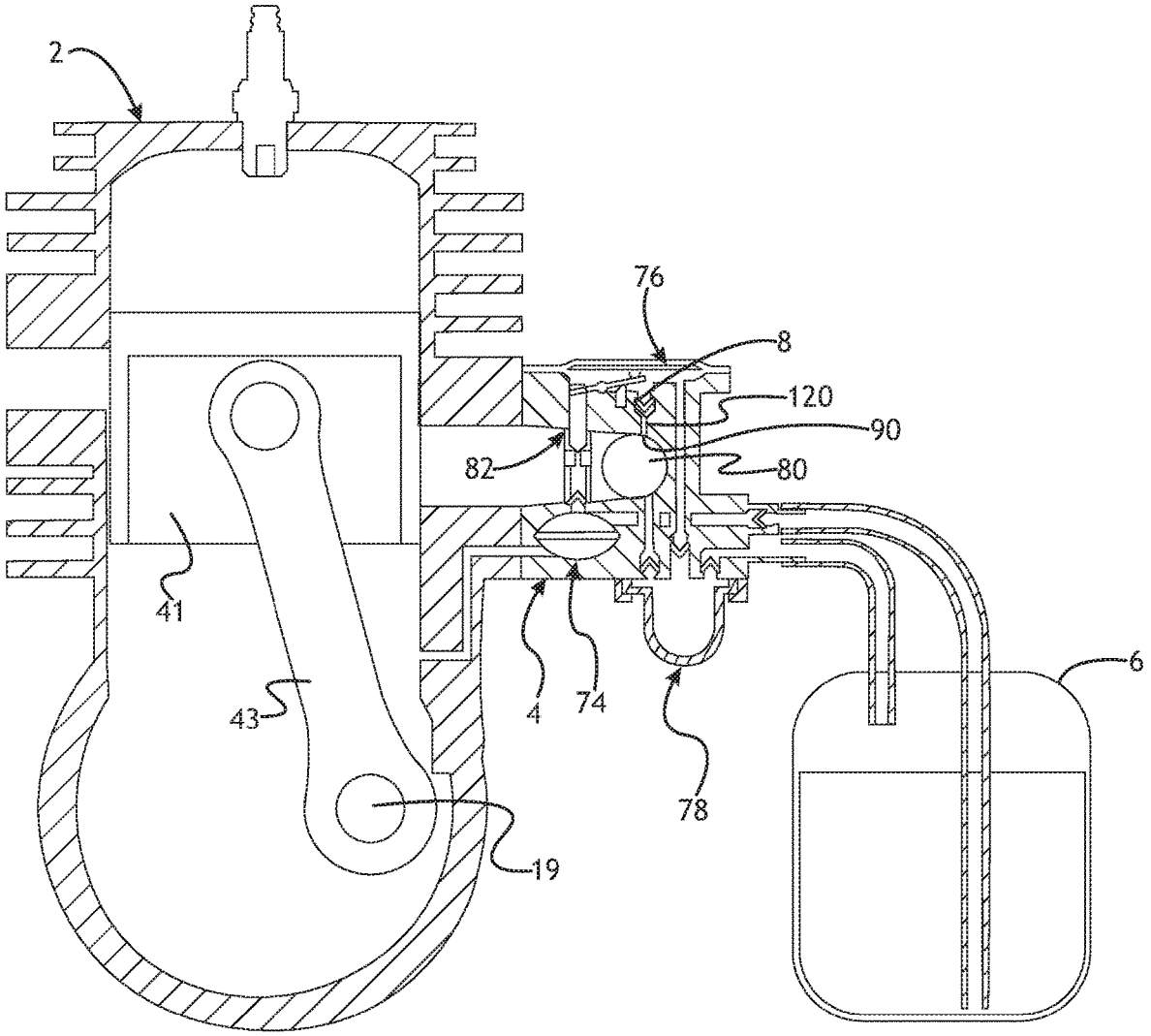
FIG. 1 is a schematic view of an engine and a carburetor including a fuel mixture control device.

Referring in more detail to the drawings, FIG. 1 illustrates an engine 2 and a charge forming device 4 that delivers a fuel and air mixture to the engine 2 to support engine operation. In at least one implementation, the charge forming device 4 includes a carburetor, and the carburetor may be of any suitable type including, for example, diaphragm and float bowl carburetors. A diaphragm-type carburetor 4 is shown in FIG. 1. The carburetor 4 takes in fuel from a fuel tank 6 and includes a mixture control device 8 capable of altering the air/fuel ratio of the mixture delivered from the carburetor. To determine a desired air/fuel ratio of the mixture, a comparison is made of the engine speed before and after the air/fuel ratio is altered. Based upon that comparison, the mixture control device 8 or some other component may be used to alter the fuel and air mixture to provide a desired air/fuel ratio of the mixture delivered to the engine.

Figure 2:
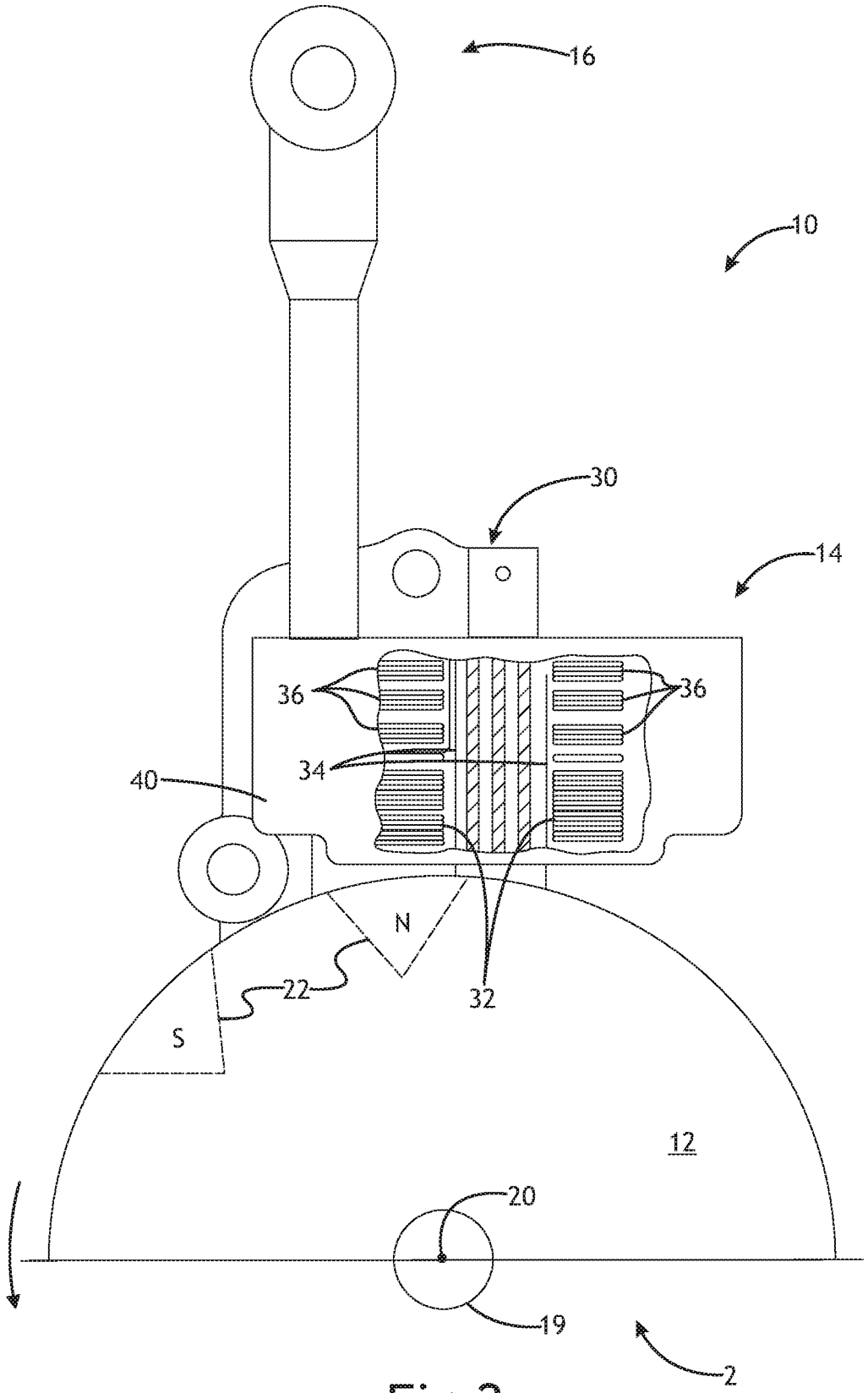
FIG. 2 is a fragmentary view of a flywheel and ignition components of the engine.
Figure 3:
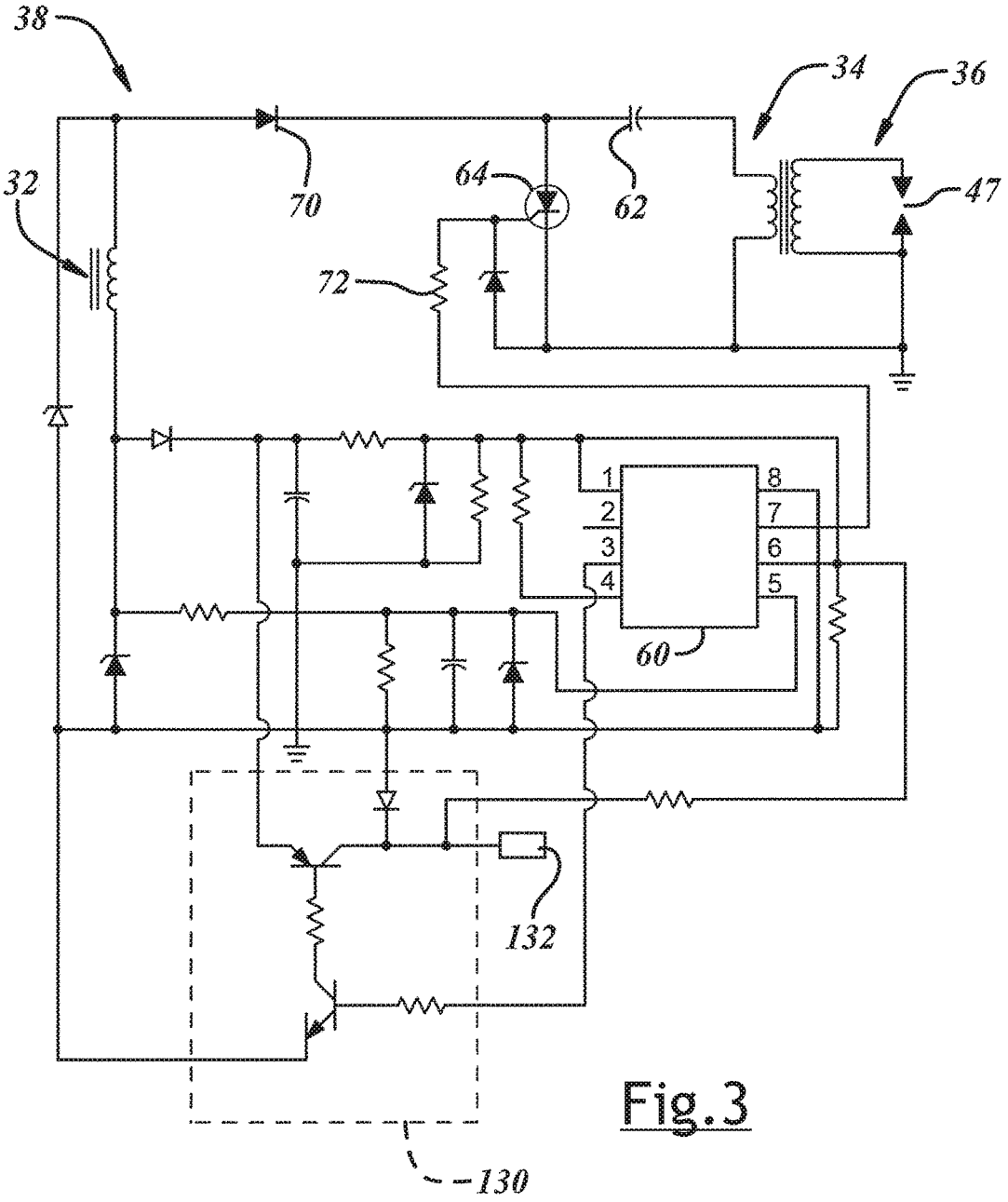
FIG. 3 is a schematic diagram of an ignition circuit.

The engine speed may be determined in a number of ways, one of which uses signals within an ignition system 10 such as may be generated by a magnet on a rotating flywheel 12. FIGS. 2 and 3 illustrates an exemplary signal generation or ignition system 10 for use with an internal combustion engine 2, such as (but not limited to) the type typically employed by hand-held and ground-supported lawn and garden equipment. Such equipment includes chainsaws, trimmers, lawn mowers, and the like. The ignition system 10 could be constructed according to one of numerous designs, including magneto or capacitive discharge designs, such that it interacts with an engine flywheel 12 and generally includes a control system 14, and an ignition boot 16 for connection to a spark plug (not shown).

As shown in FIG. 2, the flywheel 12 rotates about an axis 20 under the power of the engine 2 and includes magnets or magnetic sections 22. As the flywheel 12 rotates, the magnetic sections 22 spin past and electromagnetically interact with components of the control system 14 for sensing engine speed among other things.

The control system 14 includes a ferromagnetic stator core or lamstack 30 having wound thereabout a charge winding 32, a primary ignition winding 34, and a secondary ignition winding 36. The primary and secondary windings 34, 36 basically define a step-up transformer or ignition coil used to fire a spark plug. The control system also includes a circuit 38 (shown in FIG. 3), and a housing 40, wherein the circuit 38 may be located remotely from the lamstack 30 and the various windings. As the magnetic sections 22 are rotated past the lamstack 30, a magnetic field is introduced into the lamstack 30 that, in turn, induces a voltage in the various windings. For example, the rotating magnetic sections 22 induce a voltage signal in the charge winding 32 that is indicative of the revolution speed or number of revolutions per second of the engine 2 in the control system. The signal can be used to determine the rotational speed of the flywheel 12 and crankshaft 19 and, hence, the engine 2. Finally, the voltage induced in the charge winding 32 is also used to power the circuit 38 and charge an ignition discharge capacitor 62 in known manner. Upon receipt of a trigger signal and referring to FIG. 3, the capacitor 62 discharges through the primary winding 34 of the ignition coil to induce a stepped-up high voltage in the secondary winding 36 of the ignition coil that is sufficient to cause a spark across a spark gap of a spark plug 47 to ignite a fuel and air mixture within a combustion chamber of the engine.

In normal engine operation, downward movement of an engine piston 41 (FIG. 1) during a power stroke drives a connecting rod 43 (FIG. 1) that, in turn, rotates the crankshaft 19 (FIGS. 1 and 2), which rotates the flywheel 12. As the magnetic sections 22 rotate past the lamstack 30, a magnetic field is created which induces a voltage in the nearby charge winding 32 which is used for several purposes. First, the voltage may be used to provide power to the control system 14, including components of the circuit 38. Second, the induced voltage is used to charge the main discharge capacitor 62 that stores the energy until it is instructed to discharge, at which time the capacitor 62 discharges its stored energy across primary ignition winding 34. Lastly, the voltage induced in the charge winding 32 is used to produce an engine speed input signal, which is supplied to a microcontroller 60 of the circuit 38. This engine speed input signal can play a role in the operation of the ignition timing, as well as controlling an air/fuel ratio of a fuel mixture delivered to the engine, as set forth below.

Referring now primarily to FIG. 3, the control system 14 includes the circuit 38 as an example of the type of circuit that may be used to implement the ignition timing control system 14. However, many variations of this circuit 38 may alternatively be used without departing from the scope of the invention. The circuit 38 interacts with the charge winding 32, primary ignition winding 34, and preferably a kill switch, and generally comprises the microcontroller 60, an ignition discharge capacitor 62, and an ignition thyristor 64.

The microcontroller 60 as shown in FIG. 3 may be an 8-pin processor, which utilizes internal memory or can access other memory to store code as well as for variables and/or system operating instructions. Any other desired controllers, microcontrollers, or microprocessors may be used, however. Pin 1 of the microcontroller 60 is coupled to the charge winding 32 via a resistor and diode, such that an induced voltage in the charge winding 32 is rectified and supplies the microcontroller with power. Also, when a voltage is induced in the charge winding 32, as previously described, current passes through a diode 70 and charges the ignition discharge capacitor 62, assuming the ignition thyristor 64 is in a non-conductive state. The ignition discharge capacitor 62 holds the charge until the microcontroller 60 changes the state of the thyristor 64. Microcontroller pin 5 is coupled to the charge winding 32 and receives an electronic signal representative of the engine speed. The microcontroller uses this engine speed signal to select a particular operating sequence, the selection of which affects the desired spark timing. Pin 7 is coupled to the gate of the thyristor 64 via a resistor 72 and transmits from the microcontroller 60 an ignition signal which controls the state of the thyristor 64. When the ignition signal on pin 7 is low, the thyristor 64 is nonconductive and the capacitor 62 is allowed to charge. When the ignition signal is high, the thyristor 64 is conductive and the capacitor 62 discharges through the primary winding 34, thus causing an ignition pulse to be induced in the secondary winding 36 and sent on to the spark plug 47. Thus, the microcontroller 60 governs the discharge of the capacitor 62 by controlling the conductive state of the thyristor 64. Lastly, pin 8 provides the microcontroller 60 with a ground reference.

To summarize the operation of the circuit, the charge winding 32 experiences an induced voltage that charges ignition discharge capacitor 62, and provides the microcontroller 60 with power and an engine speed signal. The microcontroller 60 outputs an ignition signal on pin 7, according to the calculated ignition timing, which turns on the thyristor 64. Once the thyristor 64 is conductive, a current path through the thyristor 64 and the primary winding 34 is formed for the charge stored in the capacitor 62. The current discharged through the primary winding 34 induces a high voltage ignition pulse in the secondary winding 36. This high voltage pulse is then delivered to the spark plug 47 where it arcs across the spark gap thereof, thus igniting an air/fuel charge in the combustion chamber to initiate the combustion process.

As noted above, the microcontroller 60, or another controller, may play a role in altering an air/fuel ratio of a fuel mixture delivered by a carburetor 4 (for example) to the engine 2. In the non-limiting embodiment of FIG. 1, the carburetor 4 is a diaphragm type carburetor with a diaphragm fuel pump assembly 74, a diaphragm fuel metering assembly 76, and a purge/prime assembly 78, the general construction and function of each of which is well-known. The carburetor 4 includes a fuel and air mixing passage 80 that receives air at an inlet end and fuel through a fuel circuit 82 supplied with fuel from the fuel metering assembly 76. The fuel circuit 82 includes one or more passages, port and/or chambers formed in a carburetor main body. One example of a carburetor of this type is disclosed in U.S. Pat. No. 7,467,785, the disclosure of which is incorporated herein by reference in its entirety. The mixture control device 8 is operable to alter the flow of fuel in at least part of the fuel circuit to alter the air/fuel ratio of a fuel mixture delivered from the carburetor 4 to the engine to support engine operation as commanded by a throttle.

Figure 4:
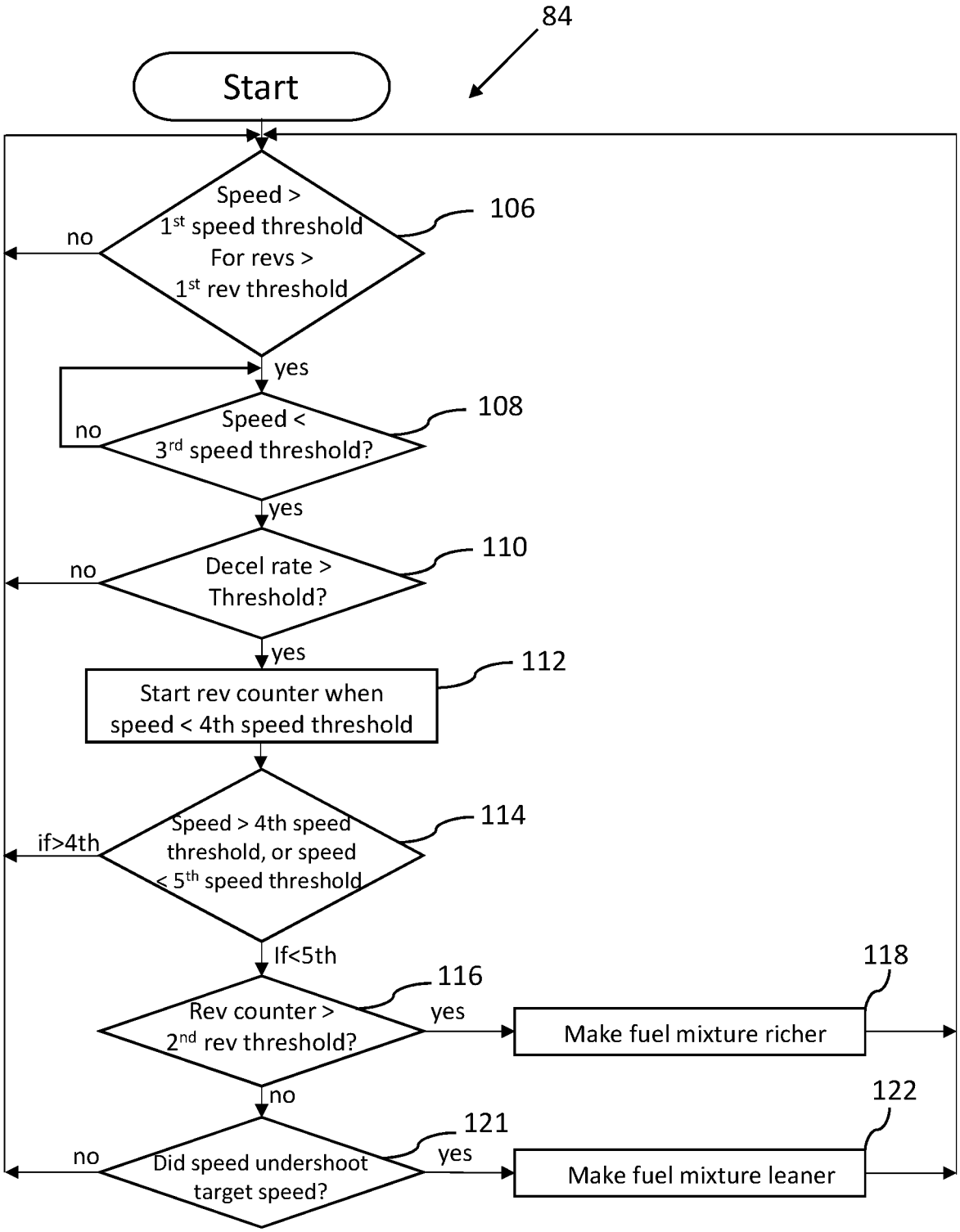
FIG. 4 is a flowchart for an engine control process.

One example of an engine control process 84 is shown in FIG. 4 and includes determining or detecting one or more characteristics of engine deceleration to determine if the fuel and air mixture needs to be made leaner or richer. The engine control process 84 begins at 106 wherein it is determined if the engine speed has been above a first speed threshold for a given number of consecutive revolutions which may be a first revolution threshold. The first speed threshold may be a speed above the engine idle speed, and may be a speed indicative of the engine being used to operate a tool associated with the engine (e.g. a string or blade trimmer, the chain of a chainsaw, the blade of a lawnmower, the auger of a snow thrower, etc) or at least accelerated significantly above idle speed. For example, the first speed threshold may be at least 2,500 rpm higher than idle speed, or at least 50% greater than idle speed. In some implementations, a clutch may be provided to inhibit or prevent driving the tool when the engine speed is below a clutch-in speed, which may be a second speed threshold. The first speed threshold may, in at least some implementations, be greater than the second speed threshold and indicative that the engine is at a speed wherein the tool is being driven. In other implementations, the first speed threshold may be equal to or less than the second speed threshold. In at least some implementations, the first speed threshold may be between 5,000 rpm and 9,000 rpm, and the clutch-in speed may be between about 4,000 rpm and 4,500 rpm, although other speeds may be used if desired. In at least some implementations, the first revolution threshold may be between 1 and 5,000 revolutions.

After the engine has been operating at or above the first speed threshold for a number of revolutions equal to or greater than the first revolution threshold, the process determines at 108 if the engine speed has dropped below a third speed threshold, which is less than the first speed threshold. This indicates that the engine has decelerated. In at least some implementations, the third speed threshold may be between 10 rpm and 4,000 rpm less than the first speed threshold. If the deceleration is of a certain magnitude, the process continues to step 110, and if not, the process returns to check the engine speed again in step 108.

In step 110, the rate of deceleration is checked against a deceleration rate threshold. This step may be provided to ensure that the engine deceleration is not due to load on the engine from use of the tool but is instead deceleration due to a reduction in throttle intending to slow the engine speed. The deceleration rate threshold may be set based upon the particular application and tool being used. For example, the engine may decelerate at a lower rate when driving a string trimming tool as opposed to a blade cutter or other heavier tool (i.e. tool of greater mass). Accordingly, the deceleration rate threshold may be lower for a tool having less mass than for a tool having greater mass. In at least some implementations, the deceleration rate threshold is between 5 rpm/revolution and 300 rpm/revolution. If the rate of deceleration is greater than the deceleration threshold, the process continues to step 112. If not, the process returns to step 106.

In step 112, a counter is initiated to count engine revolutions when the engine speed decreases to a value below a fourth speed threshold. The fourth speed threshold, in at least some implementations, may be greater than the clutch-in speed (e.g. greater than the second speed threshold). The fourth speed threshold is also less than the third speed threshold and may be chosen to be a value indicative that the engine has decelerated (e.g. from a tool operating speed) but remains above the clutch engagement or other speed threshold. The fourth speed threshold may also be below an expected operating range, that is, below speeds at which operation of the tool occurs. In this way, the engine deceleration not caused by engagement of the tool can be used to reduce the variability in loads, engine speed and the like associated with tool engagement and use. In at least some implementations, the fourth speed threshold is between 4,000 rpm and 8,000 rpm. In at least some implementations, the fourth speed threshold is below the clutch engagement speed so that the tool is not engaged and being driven and the effect of the tool can be removed. Of course, other implementations are possible.

With the counter running, the engine speed is measured in step 114 until either the engine speed goes above the fourth speed threshold or below a fifth speed threshold that is less than the fourth speed threshold. If the engine speed increases to a speed above the fourth speed threshold, the process returns to step 106 because the engine is no longer decelerating and has instead been accelerated. If the engine speed drops below the fifth speed threshold, the process continues to step 116. The fifth speed threshold is chosen to provide a cutoff for the revolution counter. The fifth speed threshold may be greater than or equal to a nominal idle engine speed. The nominal idle speed may include a range of speeds including speeds above and below a desired speed, and in at least some implementations, the fifth speed threshold is above the upper limit of the idle speed range. The nominal idle speed (sometimes only called the idle speed) may be a predetermined value for a given engine rather than an actually measured value for any given engine. In at least some implementations, the fifth speed threshold is between 2,000 rpm and 5,000 rpm. The values chosen for the fourth and fifth thresholds may be in an area of the engine speed range in which the rate of deceleration is noticeably different when the engine is running too lean compared to when the engine is running too rich. The actual value of the thresholds may change from one engine to another. Hence, the rate of deceleration can be noted in this range between these thresholds to determine if the engine is running too rich or too lean. In at least some implementations, the fourth and fifth thresholds are set to be below an expected tool operating range and above an expected idle speed of the engine.

In step 116, the number of revolutions required to drop from the fourth threshold to the fifth threshold is compared to a second revolution threshold. The second revolution threshold is set as a function of the engine and tool being driven by the engine and may vary from one application to the next. As noted above, a decelerating engine's speed will decrease more rapidly when driving a tool with more mass than a tool with less mass. Accordingly, the engine speed can be expected to decrease from the fourth speed threshold to the fifth speed threshold in fewer revolutions when a tool with greater mass is coupled to the engine. In at least some implementations, the second revolution threshold is between 10 revolutions and 300 revolutions. If the counted number of revolutions is greater than the second revolution threshold, the process continues to step 118. If not, the process continues to step 121. In at least some implementations, the engine may decelerate between 10 and 50 percent faster when running rich compared to an engine that is running lean.

In step 118, the air-fuel mixture delivered to the engine may be adjusted. In at least some implementations, an engine that is lean will take longer to decelerate from the fourth speed threshold to the fifth speed threshold. Accordingly, when the revolution counter is greater than the second revolution threshold, it is an indication that the engine is running lean. In view of this, the fuel-air mixture may be adjusted to be richer in step 118. Thereafter, the process may return to step 106 and will begin again when the requirements of step 106 are satisfied.

In step 121, the engine speed is compared to a sixth speed threshold which may be a nominal idle speed of the engine, or a speed to which the engine stabilizes over a number of revolutions equal to a third revolution threshold. The engine speed may be stabilized when it is within a certain range, that is, within plus or minus 30 rpm of the sixth speed threshold. The third revolution threshold may be set to ensure that the engine speed has stabilized for a significant enough period of time and is not subject to further deceleration. In at least some implementations, the sixth speed threshold may be between 2,000 rpm and 3,500 rpm, and the third revolution threshold may be between 50 revolutions and 200 revolutions. In step 121, the engine speed may be checked after the engine speed initially decreases below the sixth speed threshold, or stabilized speed value. If the engine was running rich, the engine speed typically will undershoot or decrease below a seventh speed threshold which is less than the sixth speed threshold by more than the normal magnitude of speed variation as the engine stabilizes (i.e. greater than +/−30 rpm).

In at least some implementations, the seventh threshold is between 60 and 200 rpm less than the sixth speed threshold and the engine speed is checked to see if the speed reaches or decreases below the seventh speed threshold within a fourth revolution threshold starting from when the engine speed reaches the sixth threshold. That is, a counter may be initiated when the engine speed reaches the sixth speed threshold and that counter value used to define a period in which the engine speed is compared to the seventh speed threshold. If the engine speed decreased to or below the seventh speed threshold during or close to an initial deceleration below the sixth speed threshold (and the engine speed decreased from the fourth to the fifth speed threshold in fewer than the second revolution threshold, which was required to reach step 121) then that is an indication that the engine is running rich and the process continues to step 122 in which the fuel-air mixture may be made leaner. Thereafter, the process may return to step 106. If the engine speed did not decrease to the seventh speed threshold, then the process may return to step 106. In at least some implementations, the fourth revolution threshold may be between 10 revolutions and 100 revolutions.

Figure 5:
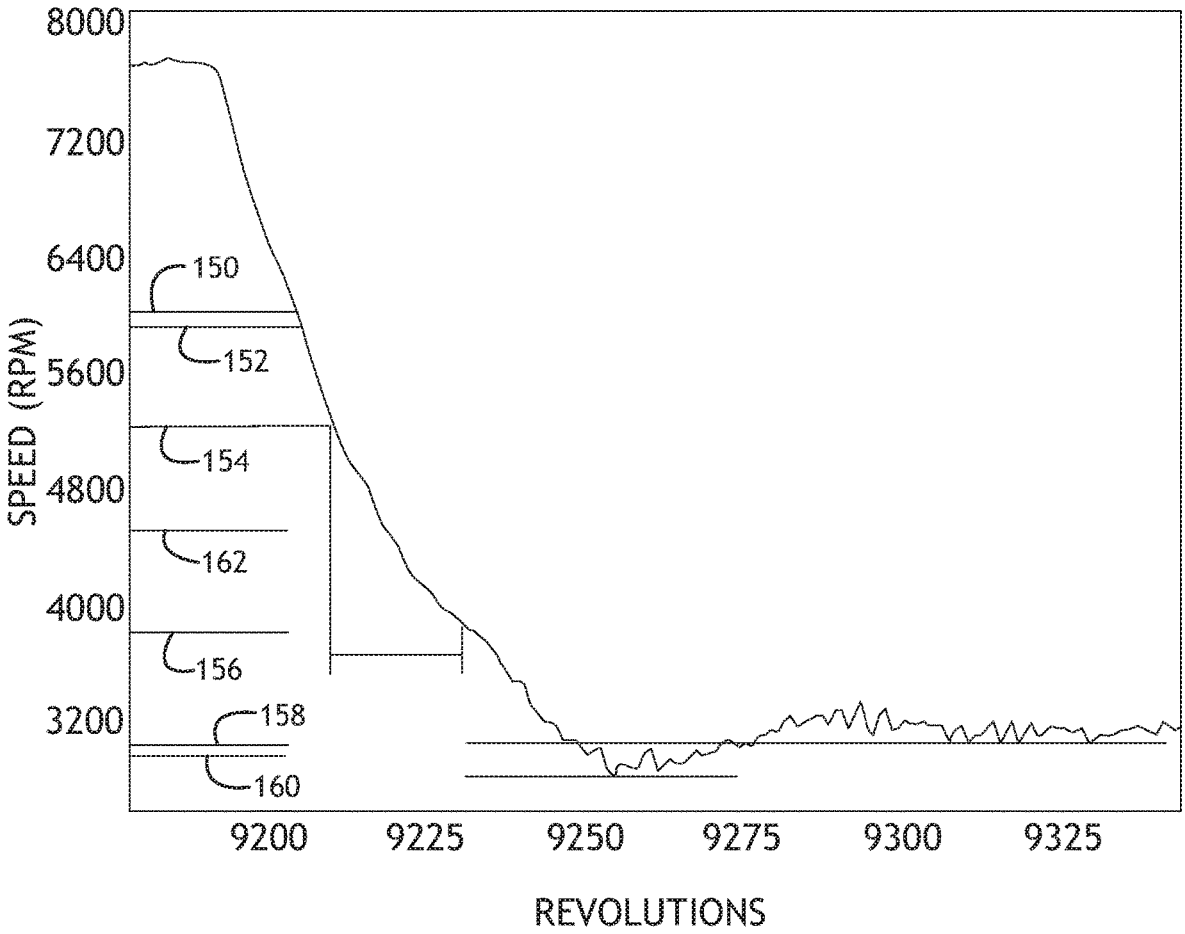
FIG. 5 is a graph of engine speed vs. revolutions illustrating deceleration of an engine that is running richer than desired.

FIG. 5 illustrates a typical graph of engine speed vs. revolutions during deceleration of an engine that is running richer than desired. Comparing this graph to the flowchart of FIG. 4 shows that step 106 was satisfied because (1) the engine was running above the first threshold (e.g. 6,000 rpm in this example, noted by line 150) for a number of revolutions exceeding the first revolution threshold (e.g. 100 engine revolutions in this example, also, it is assumed here that the speed was above the first speed threshold before the beginning of the graph). Step 108 was satisfied because the engine speed decreased below the third speed threshold, which is 5,900 rpm in this example (noted by line 152), at about revolution number 9,208. Step 110 also was satisfied as the rate of deceleration during that period (e.g. when the engine decelerated past the third speed threshold to the fourth speed threshold) was greater than the deceleration rate threshold in this example. In this example, the deceleration rate threshold is 100 rpm/revolution and in the example shown in FIG. 5, the deceleration rate was about 130 rpm/revolution. The counter in step 112 was started at about revolution 9,210 when the engine speed reached the fourth speed threshold (5,200 rpm in this example, noted by line 154), and the counter stopped at about revolution 9,333 when the engine speed reached the fifth speed threshold (3,750 rpm in this example, noted by line 156). Thus, a total of 23 engine revolutions were needed for the engine speed to drop from the fourth to the fifth speed threshold. The query in step 116 was not satisfied because the second revolution threshold was not reached (50 revolutions in this example), so the process continued to step 121 without performing step 118. With regard to step 121, the engine speed reached the sixth speed threshold (3,000 rpm in this example, noted by line 158) at about revolution 9,248, and within 30 revolutions, which is the third revolution counter in this example, the speed did undershoot (i.e. decrease to or below) the seventh speed threshold (2,850 rpm in this example, noted by line 160). Accordingly, the query in step 110 was satisfied and so the fuel-air mixture delivered to the engine was enleaned in step 122. Not used in this implementation of the method, but the second threshold, which may be a clutch-in speed, is noted by line 162.

Figure 6:
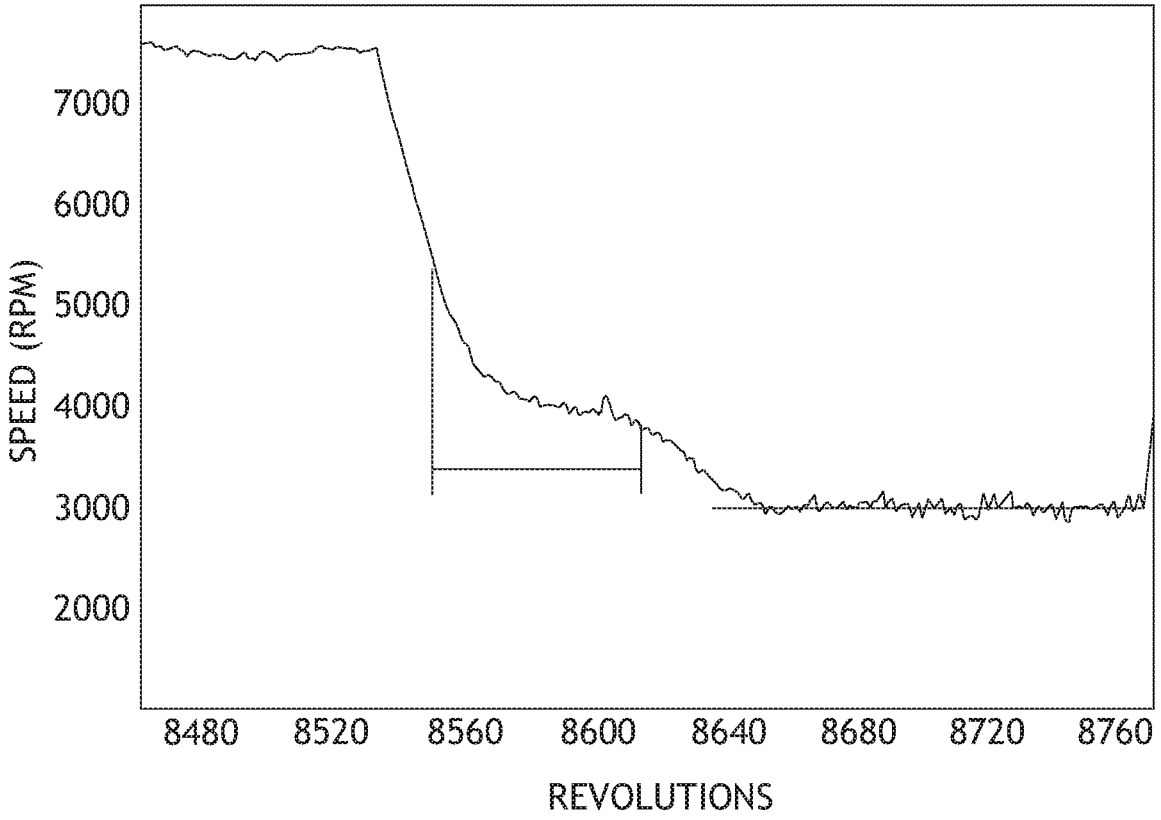
FIG. 6 is a graph of engine speed vs. revolutions illustrating deceleration of an engine that is running leaner than desired.

FIG. 6 illustrates a typical graph of engine speed vs. revolutions during deceleration of an engine that is running leaner than desired. Comparing this graph to the flowchart of FIG. 4 shows that step 106 was satisfied because (1) the engine was running above the first threshold (e.g. 6,000 rpm) for a number of revolutions exceeding the first revolution threshold (e.g. 100 engine revolutions—in this example, the speed was above the first speed threshold before the beginning of the graph). Step 108 was satisfied because the engine speed decreased below the third speed threshold (e.g. 5,900 rpm) at about revolution number 8,545. Step 110 also was satisfied as the rate of deceleration during that period (e.g. when the engine decelerated past the third speed threshold to the fourth speed threshold) was greater than the deceleration threshold of 100 rpm/revolution. In the example shown, the deceleration rate is about 130 rpm/revolution. The counter in step 112 was started at about revolution 8,550 when the engine speed reached the fourth speed threshold (5,200 rpm in this example), and the counter stopped at about revolution 8,614 when the engine speed reached the fifth speed threshold (3,750 rpm in this example). Thus, a total of 64 engine revolutions were needed for the engine speed to drop from the fourth to the fifth speed threshold, as indicated by line 170. The query in step 116 was thus satisfied because the second revolution threshold was reached (50 revolutions in this example), so the process continued to step 118 and so the fuel-air mixture delivered to the engine was enriched in step 118.

In at least some implementations, a method of controlling the fuel-to-air ratio of a fuel and air mixture supplied to an operating engine includes detecting or determining a first engine deceleration characteristic. For example, a deceleration or decrease in speed of a certain magnitude and/or at a rate of a certain magnitude. The method may also include detecting or determining one or more other deceleration characteristics to determine if the fuel-to-air ratio should be changed, that is, either made richer or leaner. An engine that is running too lean has one or more deceleration characteristics that are different than for an engine that is running too rich. The difference or differences can be detected and used to determine whether to make the fuel and air mixture richer or leaner. The deceleration characteristics may include the time or number of engine revolutions needed for the engine speed to decrease from one speed to another speed. In addition to or instead, the deceleration characteristics may include determining of the engine speed undershoots an idle or other stable engine speed upon initially decelerating to that speed. In other words, if the engine speed initially dips below the idle or stable speed when first reaching that speed during deceleration from a faster speed.

A method of controlling a fuel-to-air ratio of a fuel and air mixture supplied to an operating engine, may include:

(a) determining an engine deceleration event;
(b) detecting one or more deceleration characteristics;
(c) comparing the one or more deceleration characteristics to one or more thresholds associated with the one or more deceleration characteristics; and
(d) determining if the fuel and air mixture should be made richer or leaner based on the comparison in step (c).

A method of controlling a fuel-to-air ratio of a fuel and air mixture may include:

(a) determining an engine deceleration event;
(b) determining the number of engine revolutions required for the engine speed to decrease from one speed threshold to another speed threshold;
(c) comparing the number of engine revolutions determined in (b) against a revolution threshold; and
(d) making the fuel and air mixture richer if the number of engine revolutions determined in (b) is greater than the revolution threshold.

In at least some implementations, step (a) includes the steps 106 and 108 as set forth herein, step (b) includes step 114, step (c) includes step 116, and step (d) includes step 118.

(e) determining if, before the engine stabilized at a stable engine speed, the engine speed decreased below the stable engine speed as the engine decelerated to the stable engine speed from a speed above the stable engine speed; and
(f) making the fuel and air mixture leaner if the determination in (e) was affirmative.

In at least some implementations, step (e) includes step 121 and step (f) includes step 122 as set forth herein. Of course, other steps may be utilized to accomplish the broader steps and goals set forth herein.

In one form, and as noted above, the mixture control device that is used to change the air/fuel ratio as noted above includes a valve 8 that interrupts or inhibits a fluid flow within the carburetor 4. In at least one implementation, the valve 8 affects a liquid fuel flow to reduce the fuel flow rate from the carburetor 4 and thereby enlean the fuel and air mixture delivered from the carburetor to the engine. The valve may be electrically controlled and actuated. An example of such a valve is a solenoid valve. The valve 8 may be reciprocated between open and closed positions when the solenoid is actuated. In one form, the valve prevents or at least inhibits fuel flow through a passage 120 (FIG. 1) when the valve is closed, and permits fuel flow through the passage when the valve is opened. As shown, the valve 8 is located to control flow through a portion of the fuel circuit that is downstream of the fuel metering assembly and upstream of a main fuel jet that leads into the fuel and air mixing passage. Of course, the valve 8 may be associated with a different portion of the fuel circuit, if desired. By opening or closing the valve 8, the flow rate of fuel to the main fuel jet is altered (i.e. reduced when the valve is closed) as is the air/fuel ratio of a fuel mixture delivered from the carburetor and to the engine. A rotary throttle valve carburetor, while not required, may be easily employed because all fuel may be provided to the fuel and air mixing passage from a single fuel circuit, although other carburetors may be used. Also or instead, the valve or another valve may control air flow through a passage to vary the quantity or flow rate of air delivered in the fuel and air mixture.

In some engine systems, an ignition circuit 38 may provide the power necessary to actuate the solenoid valve 8. A controller 60 associated with or part of the ignition circuit 38 may also be used to actuate the solenoid valve 8, although a separate controller may be used. As shown in FIG. 3, the ignition circuit 38 may include a solenoid driver subcircuit 130 communicated with pin 3 of the controller 60 and with the solenoid at a node or connector 132. The controller may be a programmable device and may have various tables, charts or other instructions accessible to it (e.g. stored in memory accessible by the controller) upon which certain functions of the controller are based.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A method of controlling a fuel-to-air ratio of a fuel and air mixture supplied to an operating engine, comprising the steps of:

(a) determining an engine deceleration event;
(b) determining the number of engine revolutions required for the engine speed to decrease from one speed threshold to another speed threshold;
(c) comparing the number of engine revolutions determined in (b) against a revolution threshold; and
(d) making the fuel and air mixture richer if the number of engine revolutions determined in (b) is greater than the revolution threshold.

2. The method of claim 1 wherein step (a) includes comparing a rate of deceleration against a deceleration rate threshold.

3. The method of claim 1 wherein said one speed threshold is below an expected operating range of speeds for the engine.

4. The method of claim 1 wherein the revolution threshold is between 10 revolutions and 300 revolutions.

5. The method of claim 1 which also comprises the following steps:

(e) determining if, before the engine stabilized at a stable engine speed, the engine speed decreased below the stable engine speed as the engine decelerated to the stable engine speed from a speed above the stable engine speed; and (f) making the fuel and air mixture leaner if the determination in (e) was affirmative.

6. The method of claim 5 wherein the stable engine speed is an idle speed of the engine.

7. The method of claim 1 wherein step (a) includes determining if the engine speed is above a first speed threshold for a first threshold number of engine revolutions and when the engine speed decreases below the first speed threshold.

8. The method of claim 7 wherein the two speed thresholds set forth in step (b) are lower speeds than said first speed threshold.

9. The method of claim 1 wherein an engine deceleration event is determined by a decrease in engine speed of between 10 rpm and 4,000 rpm from a first speed threshold.

10. The method of claim 9 wherein in step (b) said one speed threshold is lower than the first speed threshold by greater than the magnitude of the decrease in engine speed needed to confirm a deceleration event.

11. The method of claim 1 wherein said another speed threshold is greater than or equal to a nominal idle speed of the engine.

12. The method of claim 11 wherein said another speed threshold is between 2,000 rpm and 5,000 rpm.

13. The method of claim 1 wherein the richness of the fuel and air mixture is controlled at least in part by an electrically actuated valve and wherein the richness of the fuel and air mixture is changed by changing the operation of the valve.

14. The method of claim 13 wherein the valve controls a flow of fuel and wherein closing the valve for a longer duration of time over a given time period results in a leaner fuel and air mixture and closing the valve for a shorter duration of time for said given time period results in a richer fuel and air mixture.

15. The method of claim 13 wherein the valve controls a flow of air and wherein closing the valve for a longer duration of time over a given time period results in a richer fuel and air mixture and closing the valve for a shorter duration of time for said given time period results in a leaner fuel and air mixture.

16. A method of controlling a fuel-to-air ratio of a fuel and air mixture supplied to an operating engine, comprising the steps of:

(a) determining an engine deceleration event;

(b) determining the time required for the engine speed to decrease from one speed threshold to another speed threshold;

(c) comparing the time determined in (b) to a threshold; and (d) making the fuel and air mixture richer when the time determined in (b) is greater than the threshold.

17. The method of claim 16 wherein the time is determined based upon the number of engine revolutions required for the engine speed to decrease from one speed threshold to another speed threshold.

18. The method of claim 17 wherein step (c) includes comparing the number of engine revolutions required for the engine speed to decrease from said one speed threshold to said another speed threshold against a revolution threshold.

19. The method of claim 18 wherein the revolution threshold is between 10 revolutions and 300 revolutions.

* * * * *